US009223329B2

(12) United States Patent
Pulvirenti et al.

(10) Patent No.: US 9,223,329 B2
(45) Date of Patent: Dec. 29, 2015

(54) LOW DROP OUT VOLTAGE REGULATOR WITH OPERATIONAL TRANSCONDUCTANCE AMPLIFIER AND RELATED METHOD OF GENERATING A REGULATED VOLTAGE

(71) Applicant: STMICROELECTRONICS S.r.l., Agrate Brianza (IT)

(72) Inventors: Francesco Pulvirenti, Acireale (IT); Santo Ilardo, Leonforte (IT)

(73) Assignee: STMICROELECTRONICS S.R.L., Agrate Brianza (MB) (IT)

( * ) Notice: Subject to any disclaimer, the term of this patent is extended or adjusted under 35 U.S.C. 154(b) by 194 days.

(21) Appl. No.: 14/097,796

(22) Filed: Dec. 5, 2013

(65) Prior Publication Data

US 2014/0312867 A1 Oct. 23, 2014

(30) Foreign Application Priority Data

Apr. 18, 2013 (IT) ..... MI2013A0633

(51) Int. Cl.
*G05F 1/565* (2006.01)
*G05F 1/56* (2006.01)

(52) U.S. Cl.
CPC .. *G05F 1/56* (2013.01); *G05F 1/565* (2013.01)

(58) Field of Classification Search
CPC ..... H02M 3/02–3/07; H02M 3/135–3/156; H02M 2003/1566; H02M 2003/072; G05F 1/10; G05F 1/46–1/575; G05F 3/02–3/30
USPC ..... 323/273–282, 312–317; 363/59; 327/534–543
See application file for complete search history.

(56) References Cited

U.S. PATENT DOCUMENTS

| | | | | |
|---|---|---|---|---|
| 5,631,598 | A * | 5/1997 | Miranda et al. | 327/540 |
| 5,867,048 | A * | 2/1999 | Chou | 327/172 |
| 6,188,212 | B1 * | 2/2001 | Larson et al. | 323/281 |
| 7,199,566 | B2 * | 4/2007 | Suzuki | 323/274 |
| 7,233,130 | B1 * | 6/2007 | Kay | H02M 1/143 323/222 |
| 7,825,644 | B1 * | 11/2010 | Ling | 323/282 |
| 2010/0164451 | A1 * | 7/2010 | Cerchi et al. | 323/282 |
| 2011/0032026 | A1 * | 2/2011 | Pelley | 327/536 |
| 2011/0156688 | A1 | 6/2011 | Lin et al. | |

(Continued)

FOREIGN PATENT DOCUMENTS

| | | |
|---|---|---|
| EP | 0899643 | 3/1999 |
| EP | 1635239 | 3/2006 |

*Primary Examiner* — Jessica Han
*Assistant Examiner* — David A Singh
(74) *Attorney, Agent, or Firm* — Allen, Dyer, Doppelt, Milbrath & Gilchrist, P.A.

(57) ABSTRACT

A low drop out voltage regulator includes an operational transconductance amplifier configured to be supplied with a supply voltage of the regulator, receive as inputs a reference voltage and a feedback voltage, and generate an intermediate current based upon a difference between the reference voltage and the feedback voltage. A current-to-voltage amplification stage is configured to be supplied with a boosted voltage greater than the supply voltage from a high voltage line, receive as input the intermediate current, and generate a driving voltage that is changed based upon the intermediate current. A pass transistor is controlled with the driving voltage to keep constant on a second conduction terminal thereof a regulated output voltage. A feedback network generates the feedback voltage based on the regulated output voltage.

20 Claims, 4 Drawing Sheets

(56) References Cited

U.S. PATENT DOCUMENTS

2013/0169251 A1* 7/2013 Wan et al. ..... 323/282

2014/0084994 A1* 3/2014 Merkin ..... G05F 1/56 327/543

* cited by examiner

LOW DROP OUT VOLTAGE REGULATOR WITH OPERATIONAL TRANSCONDUCTANCE AMPLIFIER AND RELATED METHOD OF GENERATING A REGULATED VOLTAGE

TECHNICAL FIELD

This disclosure relates to voltage regulators, and, more particularly, to a low drop out voltage regulator with an improved response to load variations and reduced power consumption, and a related method of generating a regulated voltage.

BACKGROUND

Low drop out (LDO) regulators are devices that provide a nominal and stable DC voltage by adjusting their internal resistance to any occurring variation of a supplied load. Because of their functioning characteristics, LDO regulators may be embedded in power management ICs for collecting energy to adapt power interfaces between an energy storage device, such as a battery or a supercapacitor, and loads functioning with a low duty cycle. Microprocessors, analog sensors and RF transceivers are example loads functioning with a low duty cycle.

To meet these requirements, power management ICs maximize power transfer from an energy collecting source to a battery and to a supplied load, and reduce power consumption. Power consumption is reduced particularly during stand-by periods due to the low duty cycle of the supplied loads.

Furthermore, load currents may vary from values below 1 μA, in stand-by conditions, to several tens of mA during data processing and transmission. For this reason, another requirement for LDO regulators in energy collecting applications is a fast response to load variations with reduced undershoots and overshoots to avoid an unwanted reset of the supplied load (e.g., a microprocessor).

A well-known basic linear voltage regulator is depicted in the block scheme of FIG. 1*a* and in the corresponding circuit of FIG. 1*b*. The linear voltage regulator comprises an error amplifier ErrAmp configured to receive as an input a reference voltage Vref, typically generated by a band-gap circuit, and a feedback voltage Vfb. The feedback voltage Vfb represents the output voltage Vout_pch, and is configured to control a pass transistor Tpass, typically a PMOS enhancement FET. The pass transistor Tpass is biased in a conduction state to regulate the output voltage Vout_pch so as to make the feedback voltage Vfb match the reference voltage Vref. The amplifier may be a differential amplifier with an active load, as shown in FIG. 1*b*. The response to load variations of this basic regulator is relatively slow, and this may make it practically unsuitable for energy collecting applications.

Another known regulator is illustrated in the block scheme of FIG. 2*a* and in the corresponding circuit of FIG. 2*b*. In this regulator, the powering voltage Vboost of the error amplifier ErrAmp is a boosted replica of the supply voltage VDD. This causes the pass NMOS transistor Tpass to function in the linear functioning region of its current-voltage characteristic when the output regulated voltage Vout_nch is close to the supply voltage VDD. The boosted powering voltage Vboost is typically generated by a charge pump generator CHARGE PUMP controlled by an oscillator operating at a fixed frequency. The amplifier may be a differential amplifier with an active load, as shown in FIG. 2*b*, in which the voltages Vref and Vfb are applied to the input terminals of the amplifier to properly drive the NMOS pass transistor Tpass.

This regulator is characterized by a fast response to load variations due to the reduced size of the load supplying NMOS transistor. This is done at the cost of greater power consumption in inactive conditions due to the presence of a charge pump generator, which may make it unsuitable for energy collecting applications.

A low drop out (LDO) regulator capable of combining the contrasting requirements of a short transient response to load variations with a very small power consumption may be advantageous for realizing energy collecting devices with reduced power consumption, and thus with improved yield.

SUMMARY

An operational transconductance amplifier (OTA) powered with the supply voltage of the regulator may be used for generating an intermediate current representing a difference between a reference voltage and a feedback voltage. A current-to-voltage amplification stage powered with a boosted voltage available on a high voltage line may be used to generate the driving voltage of the pass transistor that provides the regulated output voltage.

The operational transconductance amplifier may be a differential amplifier with an active load.

The boosted voltage may be generated by a feedback charge pump generator having a voltage controlled oscillator (VCO) controlled by the boosted voltage to reduce the oscillation frequency of the VCO as the boosted voltage approaches its nominal value.

The LDO regulator may be realized with MOS transistors and/or with BJT transistors.

DETAILED DESCRIPTION

Figure 3A:
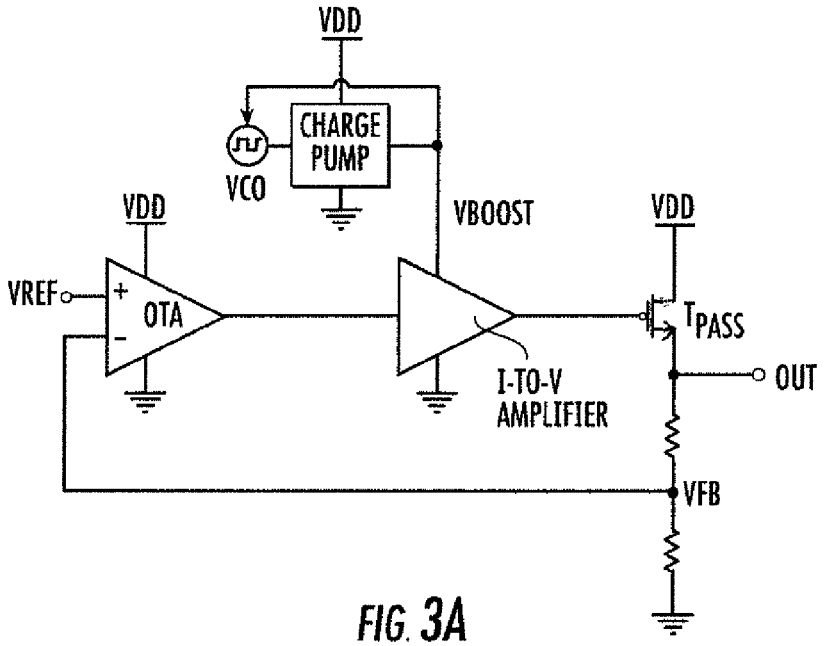
FIGS. 3*a* and 3*b* depict an embodiment of the LDO regulator and an exemplary circuit implementation thereof, respectively, according to the present disclosure.
Figure 3B:
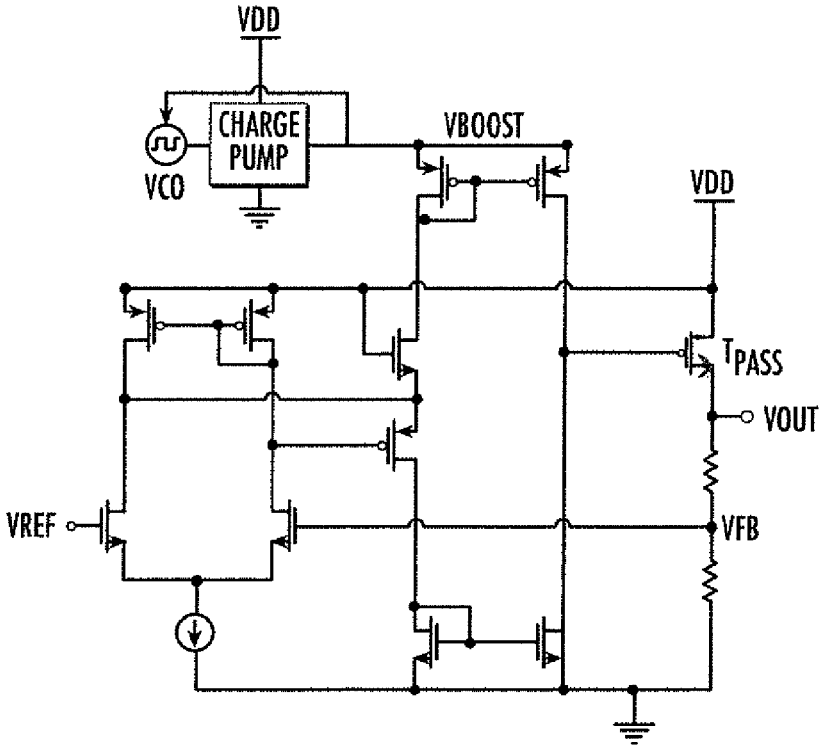

An embodiment of the LDO regulator of the present disclosure is depicted in FIG. 3*a*, and an exemplary circuit scheme thereof realized with MOS technology is illustrated in FIG. 3*b*. Corresponding circuit blocks in the figures have the same references. The same circuit may be realized with BJT technology, as readily appreciated by those skilled in the art.

The regulator comprises a charge pump generator CHARGE PUMP that provides a boosted voltage Vboost, though what will be stated below also holds if the boosted voltage Vboost is made available to the LDO regulator on a high voltage line but is generated by a device not belonging to the LDO regulator.

Figure 2A:
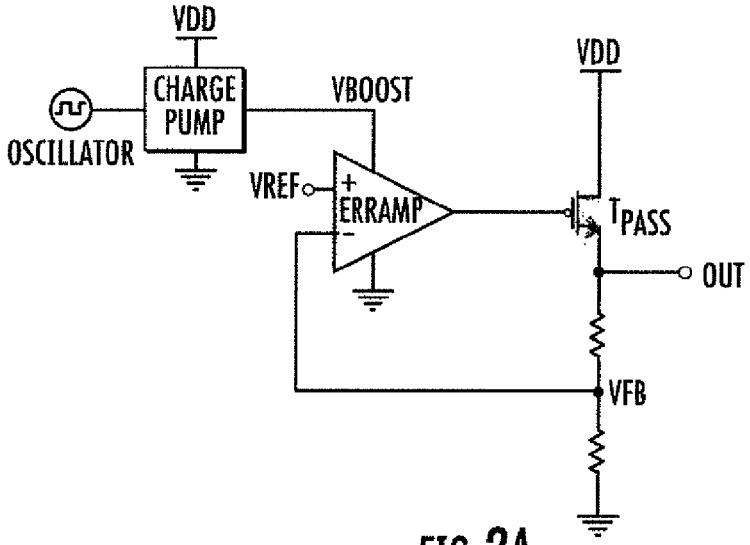
FIG. 2A PRIOR ART
FIGS. 2*a* and 2*b* depict another voltage regulator and a circuit implementation thereof, respectively, according to the prior art.

Differently from the known voltage regulator of FIG. 2*a*, the regulator disclosed herein includes an operational transconductance amplifier supplied with the supply voltage VDD that generates an intermediate current corresponding to the voltage unbalance between the reference voltage Vref and the feedback voltage Vfb. A current-to-voltage amplification stage, powered with a boosted voltage available on a high voltage line, generates a driving voltage of the pass transistor Tpass that is increased or decreased by an amount corresponding to the value and the sign of the intermediate current delivered by the operational transconductance amplifier OTA.

The current-to-voltage amplification stage draws a nonnull current from the high voltage line at the boosted voltage for charging/discharging the gate of the output pass transistor Tpass only during output load transients. When the load is stable and all transients have ceased, the charging/discharging current of the gate of the pass transistor Tpass nullifies and thus no current is drawn from the high voltage line.

Figure 1A:
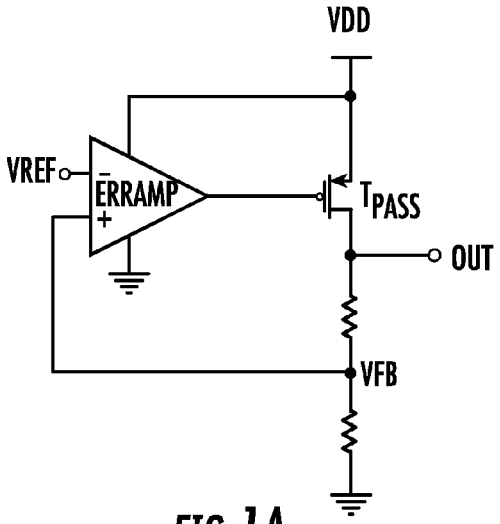
FIG. 1A PRIOR ART
FIGS. 1*a* and 1*b* depict a voltage regulator and a circuit implementation thereof, respectively, according to the prior art.

Therefore, the charge pump generator in the embodiment of FIG. 3*b* generates the boosted voltage but does not deliver any current during an inactive condition. This is different from the voltage regulator of FIG. 2*b*, and as a result, power consumption is reduced. Therefore, the current consumption in inactive functioning conditions is practically the same as in the regulator of FIG. 1*a*, but the transient responses after an abrupt increase of the current absorbed by a supplied load are relevantly faster because the pass transistor is an N-type transistor.

According to an example embodiment, the pass transistor Tpass is an NMOS transistor. The transient response after an abrupt increase of the output current may even be shorter than that of the prior regulator of FIG. 2*a*.

Figure 1B:
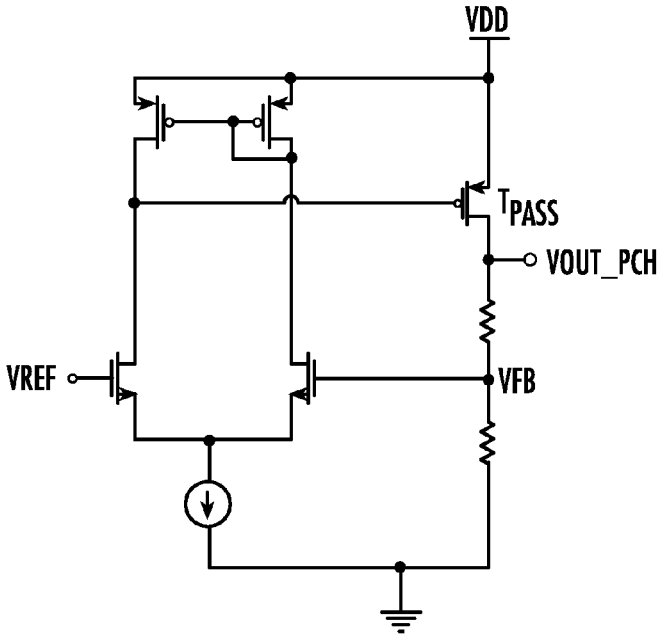
FIG. 1B PRIOR ART
Figure 2B:
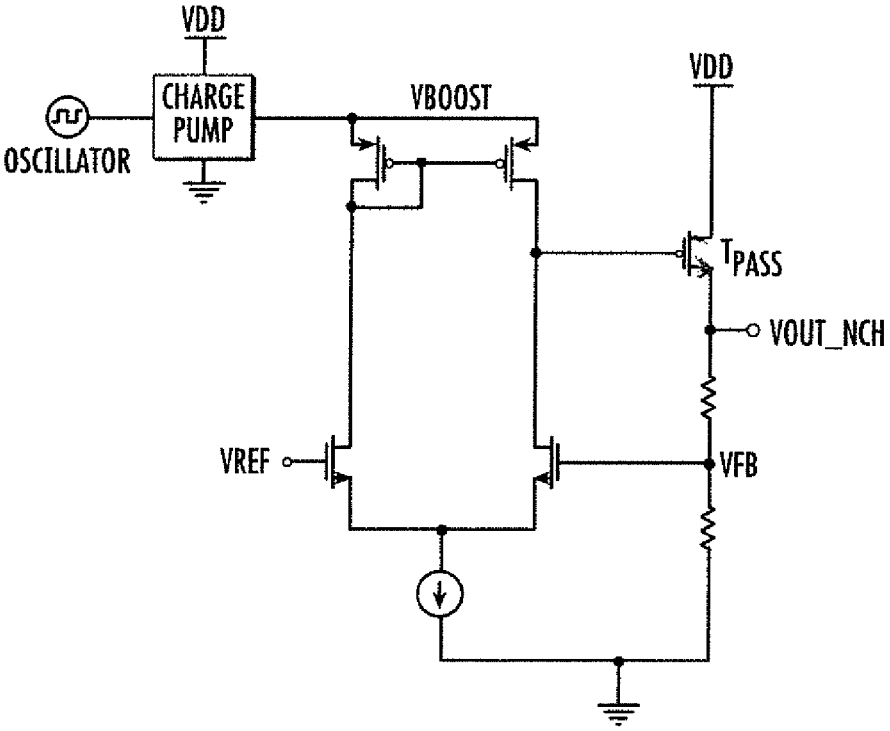
FIG. 2B PRIOR ART
Figure 4:
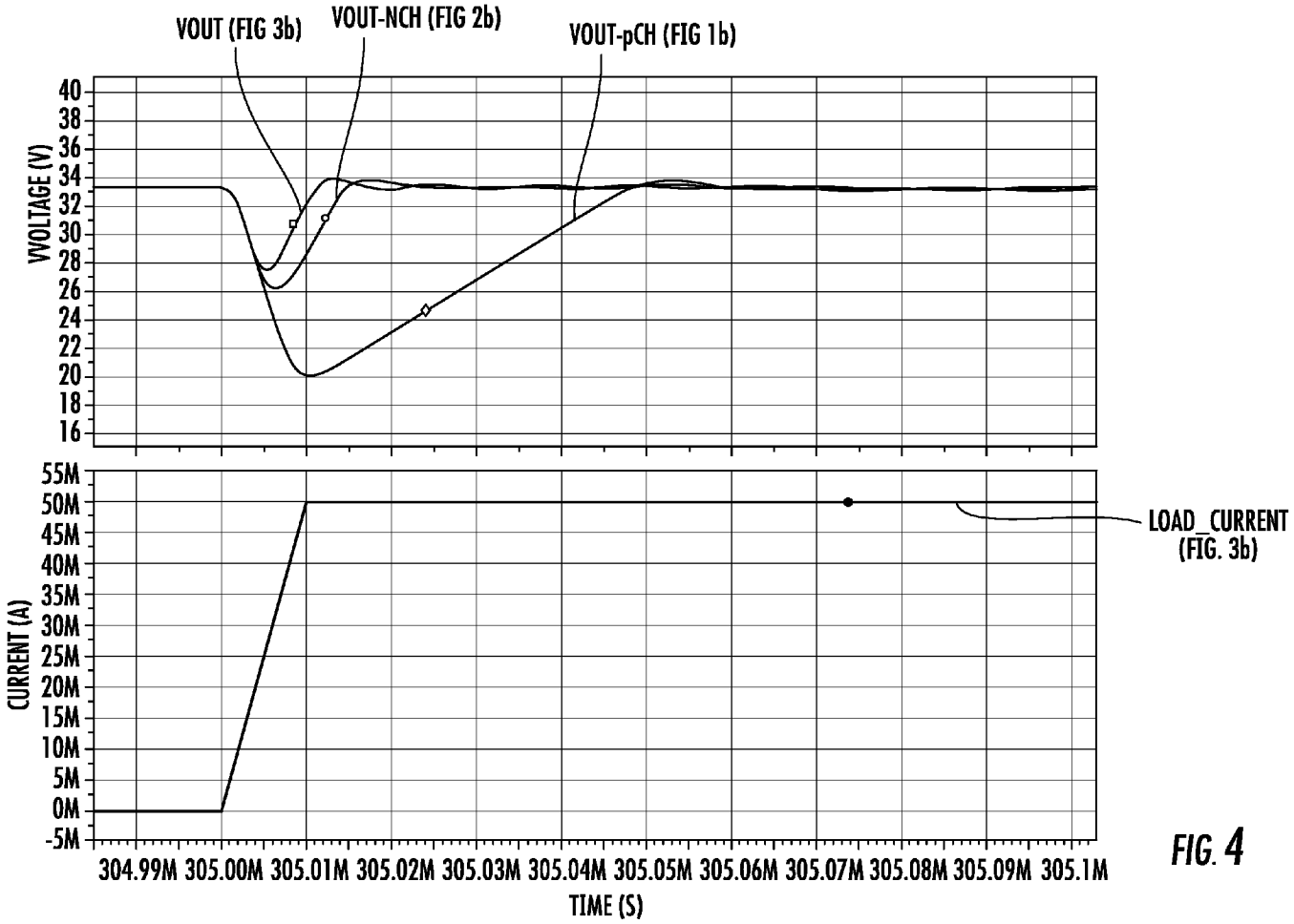
FIG. 4 compares output voltage responses of the regulators of FIGS. 1 to 3 after an abrupt increase of the output current according to the present disclosure.

FIG. 4 depicts exemplary time graphs of simulations of the circuits of FIGS. 1*b*, 2*b* and 3*b*. The regulator of FIG. 1*b* is the slowest because its pass transistor Tpass is an enhancement PMOS transistor, thus it is larger than an NMOS transistor with the same on resistance. Therefore, the NMOS pass transistor Tpass of the present LDO regulator requires a smaller charging/discharging current for obtaining the same transient performance than a PMOS transistor. Furthermore, the source follower NMOS pass transistor topology has intrinsically better performance in voltage buffer applications than the PMOS pass transistor common source topology.

The regulator of FIG. 3*b* is even faster than that of FIG. 2*b*. This is due to the fact that the overall gain of the disclosed LDO regulator is greater than the loop gain of the regulator of FIG. 2*b* using components having the same size. This is because the former is the product of the gain of the operational transconductance amplifier OTA by the gain of the current-to-voltage amplification stage. Therefore, using a current-to-voltage amplification stage with a gain >1, the current for charging/discharging the gate of the pass transistor is amplified with respect to the maximum current provided by the OTA. This improves the transient response without increasing an inactive condition power consumption of the LDO regulator.

The current-to-voltage amplification stage of FIG. 3*a* controls the pass transistor Tpass and may be realized as shown in FIG. 3*b*, but other architectures may be used provided that they are adapted to generate a voltage that is increased or decreased by an amount that corresponds to the sign and to the intensity of the intermediate current.

The current-to-voltage amplification stage as shown in FIG. 3*b* includes low-side and high-side current mirrors. The low-side current mirror includes an output transistor. Similarly, the high-side current mirror includes an output transistor. A pair of complementary transistors is coupled together in series. The pair of complementary transistors is coupled to the operational transconductance amplifier (OTA) such that the intermediate current flows through a respective transistor of the pair of complementary transistors based on a sign of the intermediate current from the operational transconductance amplifier. The pair of complementary transistors is also coupled to a voltage reference through the low-side current mirror and is coupled to the high voltage line through the high-side current mirror. The low-side and high-side current mirrors are configured to mirror a current flowing through a respective transistor of the pair of complementary transistors. The output transistors of the low-side and high-side current mirrors are coupled together in series, and with the driving voltage being made available on a common current terminal shared by the output transistors of the low-side and high-side current mirrors.

According to a further innovative characteristic of the embodiment shown in FIG. 3*a*, the boosted voltage is generated by a feedback charge pump generator CHARGE PUMP driven by a voltage controlled oscillator (VCO). The frequency of the VCO is adjusted as a function of the value of the boosted voltage Vboost effectively made available on the high voltage line. The frequency of the VCO is increased the more the boosted voltage drops below its nominal value. This feature may be particularly useful for reducing further power losses because it allows a reduction of the switching frequency of the charge pump generator, as determined by the oscillation frequency of the VCO, when there is no load transient.

The invention claimed is:

1. A low drop out voltage regulator comprising:

an operational transconductance amplifier configured to be supplied with a supply voltage of the regulator, receive as inputs a reference voltage and a feedback voltage, and generate an intermediate current based upon a difference between the reference voltage and the feedback voltage;

a current-to-voltage amplification stage configured to be supplied with a boosted voltage greater than the supply voltage from a high voltage line, receive as an input the intermediate current, and generate a driving voltage that is changed by an amount based upon a value and a sign of the intermediate current;

a pass transistor comprising first and second conduction terminals, with the first conduction terminal configured to receive the supply voltage, and with said pass transistor configured to be controlled with the driving voltage to keep constant on the second conduction terminal a regulated output voltage of the regulator; and a feedback network coupled to the second conduction terminal and configured to generate the feedback voltage based on the regulated output voltage of the regulator;

an overall gain of a loop of the low drop out voltage regulator being based on a gain of the operational transconductance amplifier multiplied by a gain of the current-to-voltage amplification stage.

2. The low drop out voltage regulator of claim 1, wherein said current-to-voltage amplification stage has a gain greater than 1.

3. The low drop out voltage regulator of claim 1, wherein said pass transistor comprises an NMOS transistor.

4. The low drop out voltage regulator of claim 1, further comprising a charge pump generator to be supplied with the supply voltage and configured to generate the boosted voltage on the high voltage line.

5. The low drop out voltage regulator of claim 4, wherein said charge pump generator comprises a voltage controlled oscillator coupled to the high voltage line that decreases in oscillation frequency as the boosted voltage approaches a nominal voltage.

6. The low drop out voltage regulator of claim 1, wherein said current-to-voltage amplification stage comprises:

a low-side current mirror comprising an output transistor;

a high-side current mirror comprising an output transistor; and a pair of complementary transistors coupled together in series, and with said pair of complementary transistors being coupled to said operational transconductance amplifier (OTA) such that the intermediate current flows through a respective transistor of said pair of complementary transistors based on a sign of the intermediate current from said operational transconductance amplifier, and with said pair of complementary transistors being coupled to a voltage reference through said low-side current mirror and coupled to the high voltage line through said high-side current mirror;

said low-side and high-side current mirrors configured to mirror a current flowing through a respective transistor of said pair of complementary transistors, with said output transistors of said low-side and high-side current mirrors being coupled together in series, and with the driving voltage being made available on a common current terminal shared by said output transistors of said low-side and high-side current mirrors.

7. A power management device comprising:

a voltage regulator comprising an amplifier configured to be supplied with a supply voltage, receive as inputs a reference voltage and a feedback voltage, and generate an intermediate current based upon a difference between the reference voltage and the feedback voltage, an amplification stage configured to be supplied with a boosted voltage greater than the supply voltage, receive as an input the intermediate current, and generate a driving voltage that is changed based on the intermediate current, a transistor comprising first and second conduction terminals and a control terminal, with the first conduction terminal configured to receive the supply voltage, and with said transistor configured to be controlled with the driving voltage received by the control terminal to keep constant on the second conduction terminal a regulated output voltage of the regulator, and a feedback network coupled to the second conduction terminal and configured to generate the feedback voltage based on the regulated output voltage of the regulator;

with an overall gain of a loop of the voltage regulator being based on a gain of the amplifier multiplied by a gain of the amplification stage.

8. The power management device of claim 7, wherein said amplification stage has a gain greater than 1.

9. The power management device of claim 7, wherein said transistor comprises an NMOS transistor.

10. The power management device of claim 7, further comprising a charge pump generator to be supplied with the supply voltage and configured to generate the boosted voltage.

11. The power management device of claim 10, wherein said charge pump generator comprises a voltage controlled oscillator that decreases in oscillation frequency as the boosted voltage approaches a nominal voltage.

12. The power management device of claim 7, wherein said amplification stage comprises:

a low-side current mirror comprising an output transistor;

a high-side current mirror comprising an output transistor; and a pair of complementary transistors coupled together in series, and with said pair of complementary transistors being coupled to said amplifier such that the intermediate current flows through a respective transistor of said pair of complementary transistors based on a sign of the intermediate current, and with said pair of complementary transistors being coupled to a voltage reference through said low-side current mirror and coupled to the high voltage line through said high-side current mirror;

said low-side and high-side current mirrors configured to mirror a current flowing through a respective transistor of said pair of complementary transistors, with said output transistors of said low-side and high-side current mirrors being coupled together in series, and with the driving voltage being made available on a common current terminal shared by said output transistors of said low-side and high-side current mirrors.

13. A method of generating a regulated output voltage from a voltage regulator comprising:

operating an amplifier supplied with a supply voltage while receiving as inputs a reference voltage and a feedback voltage, and generating an intermediate current based upon a difference between the reference voltage and the feedback voltage;

operating an amplification stage supplied with a boosted voltage greater than the supply voltage while receiving as an input the intermediate current, and generating a driving voltage that is changed based on the intermediate current;

operating a transistor comprising first and second conduction terminals and a control terminal, with the first conduction terminal receiving the supply voltage, and with the transistor being controlled with the driving voltage received by the control terminal to keep constant on the second conduction terminal the regulated output voltage; and operating a feedback network coupled to the second conduction terminal while generating the feedback voltage based on the regulated output voltage;

with an overall gain of a loop of the voltage regulator being based on a gain of the amplifier multiplied by a gain of the amplification stage.

14. The method of claim 13, wherein the amplification stage has a gain greater than 1.

15. The method of claim 13, wherein the transistor comprises an NMOS transistor.

16. The method of claim 13, further comprising operating a charge pump generator supplied with the supply voltage to generate the boosted voltage.

17. The method of claim 16, wherein the charge pump generator comprises a voltage controlled oscillator that decreases in oscillation frequency as the boosted voltage approaches a nominal voltage.

18. The method of claim 13, wherein the amplification stage comprises a low-side current mirror comprising an output transistor, a high-side current mirror comprising an output transistor, and a pair of complementary transistors coupled together in series, and with the pair of complementary transistors being coupled to the amplifier (OTA) such that the intermediate current flows through a respective transistor of the pair of complementary transistors based on a sign of the intermediate current from the operational transconductance amplifier, and with the pair of complementary transistors being coupled to a reference voltage through the low-side current mirror and coupled to the high voltage line through the high-side current mirror;

the low-side and high-side current mirrors configured to mirror a current flowing through a respective transistor of the pair of complementary transistors, with the output transistors of the low-side and high-side current mirrors being coupled together in series, and with the driving voltage being made available on a common current terminal shared by the output transistors of the low-side and high-side current mirrors.

19. A method of generating a regulated voltage from a voltage regulator comprising:

generating a feedback voltage representative of a generated output regulated voltage;

generating an intermediate current corresponding to a difference between a reference voltage and the feedback voltage using an error amplifier supplied with a supply voltage;

using a current-to-voltage amplification stage supplied with a boosted voltage available on a high voltage line for generating a driving voltage that is increased/decreased by an amount corresponding to a value and sign of the intermediate current; and generating the output regulated voltage by controlling a pass transistor with the driving voltage;

with an overall gain of a loop of the voltage regulator being based on a gain of the error amplifier multiplied by a gain of the current-to-voltage amplification stage.

20. The method of claim 19, further comprising:

generating the boosted voltage greater than the supply voltage using a charge pump generator driven by a voltage controlled oscillator coupled to the high voltage line; and decreasing an oscillation frequency of the voltage controlled oscillator as the boosted voltage approaches a nominal voltage.

* * * * *